US007279649B2

(12) United States Patent
Shiroshita

(10) Patent No.: US 7,279,649 B2
(45) Date of Patent: Oct. 9, 2007

(54) SWITCH FOR VEHICLES

(75) Inventor: Manabu Shiroshita, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/508,347

(22) Filed: Aug. 23, 2006

(65) Prior Publication Data

US 2007/0045090 A1 Mar. 1, 2007

(30) Foreign Application Priority Data

Aug. 25, 2005 (JP) ..... 2005-243854
Jun. 15, 2006 (JP) ..... 2006-165864

(51) Int. Cl.
*H01H 9/00* (2006.01)

(52) U.S. Cl. ..... 200/302.1; 200/302.2; 200/302.3

(58) Field of Classification Search .. 200/302.1–302.3, 200/296, 61.81; 411/424, 999, 542; 439/556, 439/559

See application file for complete search history.

(56) References Cited

U.S. PATENT DOCUMENTS 5,063,277 A * 11/1991 Takano et al. ..... 200/531
5,382,767 A * 1/1995 Takano et al. ..... 200/531
5,957,269 A * 9/1999 Sahashi et al. ..... 200/296
6,093,899 A * 7/2000 Takano et al. ..... 200/302.1
6,396,013 B1 * 5/2002 Kondo ..... 200/302.3
6,575,787 B2 * 6/2003 Ishikawa et al. ..... 439/587
6,576,854 B2 * 6/2003 Yamanaka et al. ..... 200/302.1

FOREIGN PATENT DOCUMENTS

JP 7-39145 Y2 9/1995
JP 2003-132761 5/2003

* cited by examiner

*Primary Examiner*—Michael A Friedhofer
(74) *Attorney, Agent, or Firm*—RatnerPrestia

(57) ABSTRACT

A switch for vehicles, which temporarily holds the screw maintaining reliability, can be easily assembled, and is particularly suited for detecting the opening and closure of doors. An insertion hole is formed in a cylindrical portion of a cover covering the upper surface of a mounting plate and an operation body, the insertion hole extending into a through hole of the mounting plate. A screw is forcibly held in the insertion hole. This prevents an inconvenience of the screw escaping when a shock is given or a force is exerted from the lower side during the transit or while being attached to the vehicle.

4 Claims, 4 Drawing Sheets

SWITCH FOR VEHICLES

TECHNICAL FIELD

This invention relates to a switch for vehicles, that is chiefly mounted on an automobile for detecting the opening/closure of a door.

BACKGROUND ART

In recent years, it is a widely accepted practice to mount a switch for vehicles on the door portions of an automobile to detect the opening/closure of the doors and to control lighting in the compartment, such as turn on/off of light.

FIG. 4 is a sectional view of a conventional switch for vehicles. The switch for vehicles includes casing 1 made of an insulating resin of nearly a box-like shape with its upper surface opened, and operation body 2 made of an insulating resin. Operation body 2 is contained in casing 1 so as to move up and down, and is provided with operation portion 2A of nearly a cylindrical shape at an upper part of operation body 2.

Fixed contact 3 made of an electrically conducting metal is studded in the right inner side surface of casing 1, and terminal portion 3A of fixed contact 3 is protruding into nearly box-like connector portion 1A at the lower part of casing 1.

An end of mounting plate 4 made of an electrically conducting metal is anchored to casing 1. Mounting plate 4 is partly folded downward to form contact portion 4A, and through hole 4B is formed in the other end of mounting plate 4 that extends leftward and outward of casing 1.

Nearly U-shaped moving contact 5 made of a resilient metal plate is mounted at a central portion thereof on operation body 2, and the right and left ends of moving contact 5 are separately and resiliently contacted in a slightly deflected state to contact portion 4A and to fixed contact 3 of mounting plate 4.

Coil spring 6 is mounted in a slightly deflected state between the inner bottom surface of casing 1 and the lower surface of operation body 2. Operation body 2 is urged upward due to spring 6.

Cover 7 made of, for example, a rubber, has mounting plate 4 insert-molded therein, covers the upper surface of mounting plate 4, and has dome portion 7A thinly formed on the right side of cover 7, which is covering the upper surface of casing 1 and operation body 2.

Further, cylindrical portion 7B is formed on the upper side of through hole 4B in mounting plate 4 formed on the left side of cover 7, and insertion hole 7C of a diameter larger than through hole 4B is formed in the bottom surface of cylindrical portion 7B. Threaded portion 8A of metallic screw 8 is inserted in insertion hole 7C and in through hole 4B.

A plurality of protruded pawl portions 7D are formed on the inner side surface of cylindrical portion 7B of cover 7 to protrude inward beyond washer portion 8B of screw 8. Screw 8 is temporarily held in cylindrical portion 7B being prevented by pawl portions 7D from escaping upward. The switch for vehicles is thus constituted.

The thus constituted switch for vehicles is preserved or transited in a state where screw 8 is temporarily held in cylindrical portion 7B of cover 7. Terminal portion 3A protruding at a lower portion of casing 1 is connected by a lead wire (not shown) or the like to a lamp in the compartment through an electronic circuit (not shown) of an automobile. Screw 8 is fastened to the chassis (not shown) of the vehicle, and mounting plate 4 is grounded to the chassis via screw 8 and is attached to the door portion of the vehicle.

In a state where the doors of the automobile are closed, operation portion 2A covered by dome portion 7A of cover 7 is pushed by the door, operation body 2 moves downward while deflecting spring 6, the left end of moving contact 5 mounted on operation body 2 separates away from contact portion 4A of mounting plate 4, the connection between contact portion 4A and fixed contact 3 is broken, and the lamp in the compartment is turned off.

The door when it is opened separates away from operation portion 2A. Being urged by spring 6, therefore, operation body 2 moves upward. Contact point 5, too, moves up, returns back to the initial state of when turned on shown in FIG. 4, whereby the lamp turns on in the compartment to illuminate the interior of the compartment.

As prior art technical document information related to the invention of this application, there has been known, for example, Japanese Patent Unexamined Publication No. 2003-132761.

The switch for vehicles of the above prior art, however, has a constitution in which screw 8 is temporarily held in cylindrical portion 7B of cover 7 by protruded pawl portions 7D. Therefore, screw 8 may often escape in case shock is given thereto or a force is exerted from the lower side of the screw 8 while the switch is being transited or attached to the vehicle. If screw 8 happens to escape, screw 8 that has escaped must be inserted in cylindrical portion 7B again before tightening it, and a laborious work is required for the assembling which is inconvenient.

DISCLOSURE OF THE INVENTION

This invention is to overcome the above inconvenience, and provides a switch for vehicles, which temporarily holds the screw maintaining reliability and can be easily assembled.

In the switch for vehicles of the invention, an insertion hole is formed in a cylindrical portion of a cover covering the upper surface of a mounting plate and an operation body, the insertion hole extending into an insertion hole in the mounting plate. Further, a screw is forcibly held in the insertion hole to constitute the switch for vehicles. With the screw being forcibly held in the insertion hole extending into the through hole in the mounting plate, the screw does not escape even if shock is given or a force is exerted from the lower side during the transit or while being attached to the vehicle. Thus, there is provided a switch for vehicles that temporarily holds the screw maintaining reliability and can be easily assembled.

According to another switch for vehicles of the invention, a protruded portion protruding upward is provided on the outer side of the through hole of the mounting plate. A plurality of flow holes are formed in the outer side surface of the protruded portion, and the outer side of the protruded portion of the cover and the insertion hole are integrally formed through the flow holes.

Even if the insertion hole is twisted accompanying the fastening of the screw at the time of attaching the screw to the chassis, the twisted portion does not affect the outer side of the protruded portion due to the flow holes, making it possible to preclude such an inconvenience that the outer side of the protruded portion of the cover is deformed. The screw can be easily and reliably fastened in the cylindrical portion.

In the switch for vehicles of the invention, a protruded portion is formed on the outer periphery of the through hole, and has a plurality of flow holes formed in the outer side surface of the protruded portion.

In the switch for vehicles of the invention, a moving contact is made of a resilient metal, an end of the moving contact is resiliently contacted to a contact portion, another end is resiliently contacted to a fixed contact, and a central portion thereof is mounted on the operation body.

In the switch for vehicles of the invention, the cover is made of an elastic resin and is insert-molded on the mounting surface.

In the switch for vehicles of the invention, an insertion hole is formed in the inner bottom surface of the cylindrical portion, the insertion hole extending inward beyond the through hole of the mounting plate and having a diameter smaller than the diameter of the threaded portion.

Figure 1:
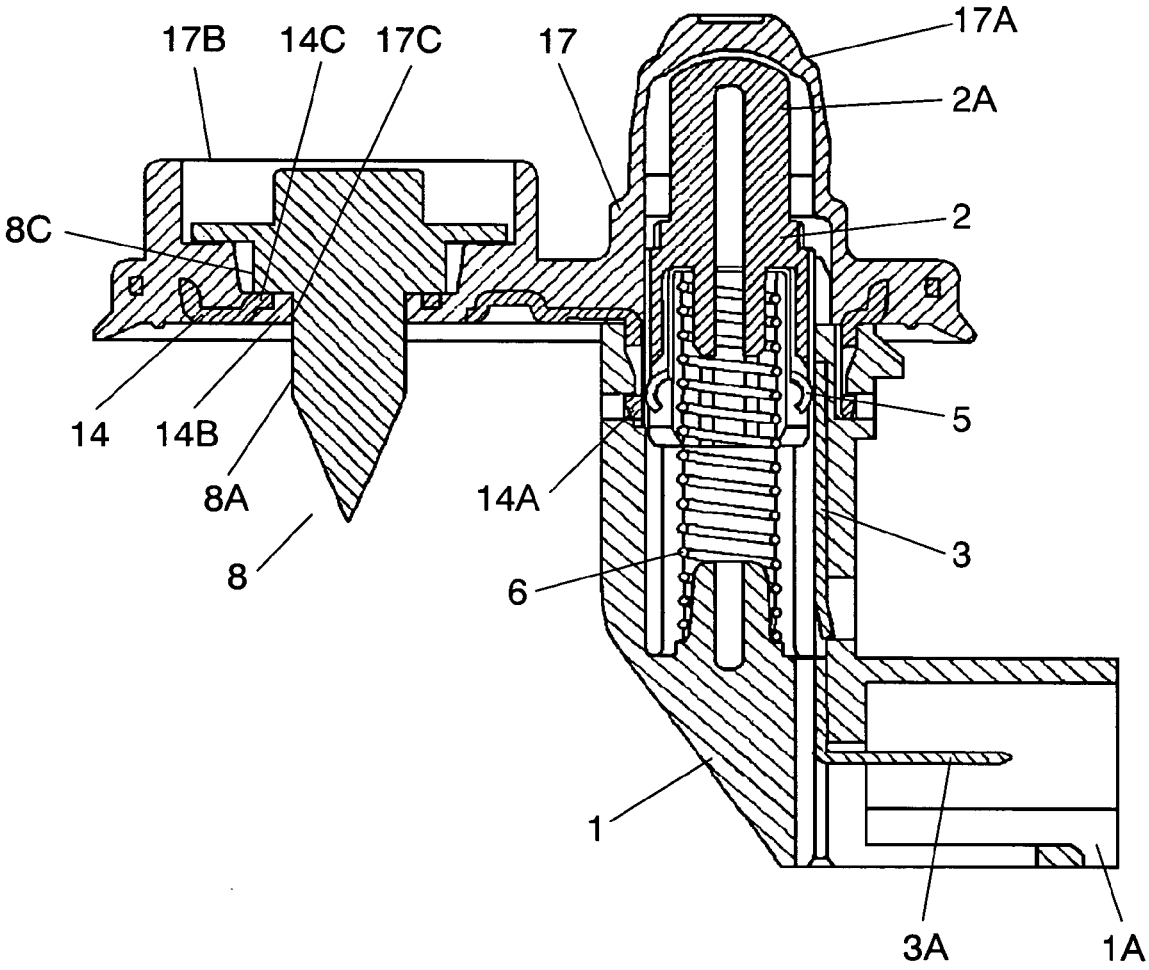
FIG. 1 is a sectional view of a switch for vehicles according to an embodiment of the invention.

| Description of Reference Numerals | |
|---|---|
| 1 | casing |
| 1A | connector portion |
| 2 | operation body |
| 2A | operation portion |
| 3 | fixed contact |
| 3A | terminal portion |
| 5 | moving contact |
| 6 | spring |
| 8 | screw |
| 8A | threaded portion |
| 8C | neck portion |
| 14 | mounting plate |
| 14A | contact portion |
| 14B | through hole |
| 14C | protruded portion |
| 14D | flow holes |
| 17 | cover |
| 17A | dome portion |
| 17B | cylindrical portion |
| 17C | insertion hole |

BEST MODE FOR CARRYING OUT THE INVENTION

An embodiment of the invention will now be described with reference to FIGS. 1 to 3.

The portions having the same constitutions as those described in the paragraph of Background Art are denoted by the same reference numerals but their description is simplified.

Figure 2:
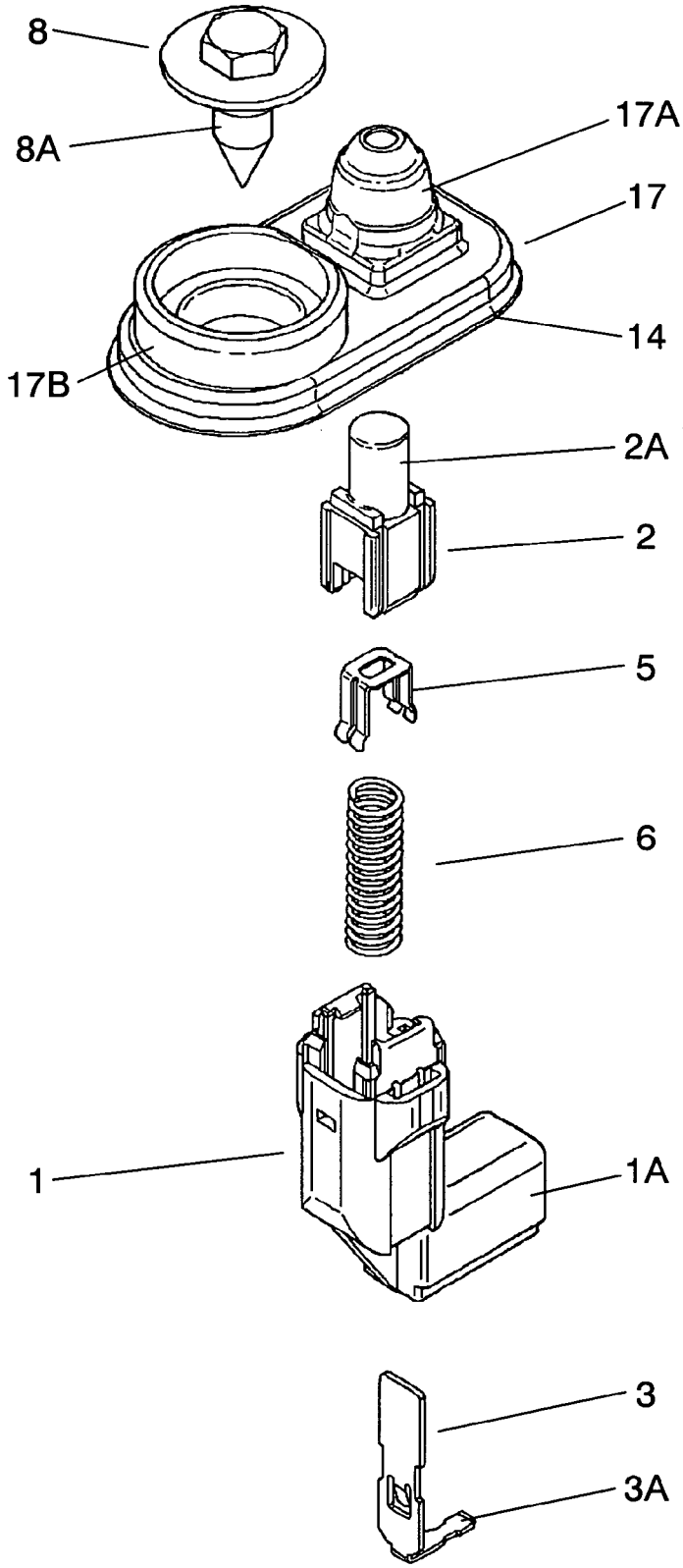
FIG. 2 is a disassembled perspective view according to the embodiment of the invention.

FIG. 1 is a sectional view of a switch for vehicles according to an embodiment of the invention, and FIG. 2 is a disassembled perspective view thereof. In FIGS. 1, 2 and 3, the switch for vehicles of the invention has nearly box-like casing 1 with its upper surface opened and is made of an insulating resin such as polyoxymethylene. Operation body 2 of an insulating resin such as polybutylene terephthalate is accommodated in casing 1 so as to move up and down. Operation portion 2A of nearly a cylindrical shape is provided on the upper part of operation body 2.

Fixed contact 3 made of an electrically conducting metal such as a copper alloy is studded in the right inner side surface of casing 1, and terminal portion 3A of fixed contact 3 is protruding into nearly box-like connector portion 1A at the lower part of casing 1.

Mounting plate 14 made of an electrically conducting metal plate such as of a steel or a copper alloy is anchored to casing 1, has contact portion 14A folded downward at the right end thereof, is extending leftward and outward of casing 1 at the left end thereof, and is, further, provided with through hole 14B therein.

Figure 3A:
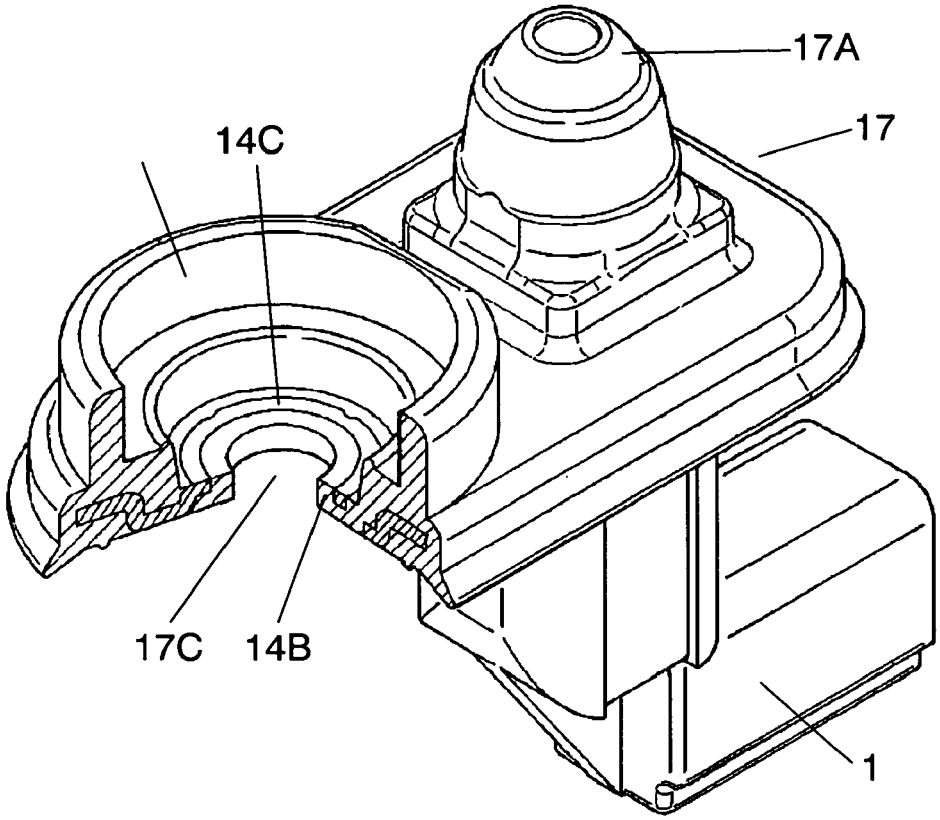
FIG. 3 includes a partial sectional perspective view and a perspective view according to the embodiment of the invention.
Figure 3B:
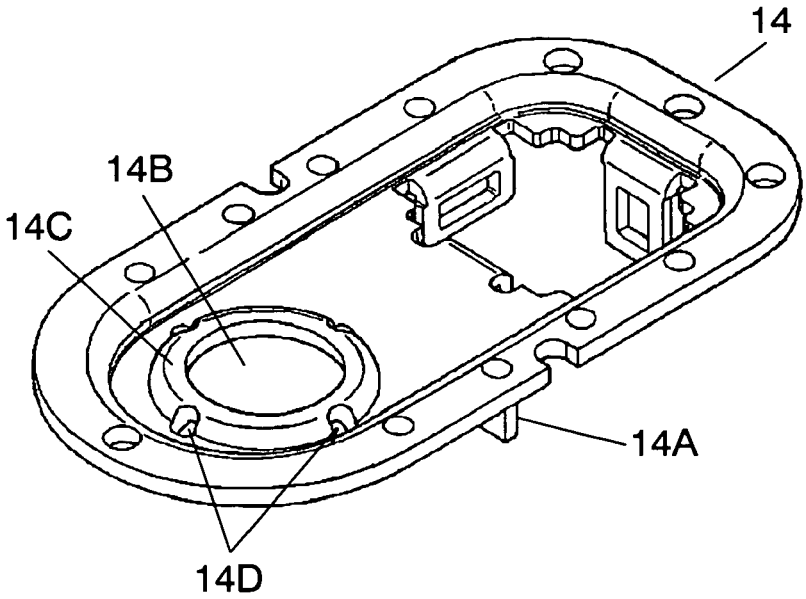
Figure 4:
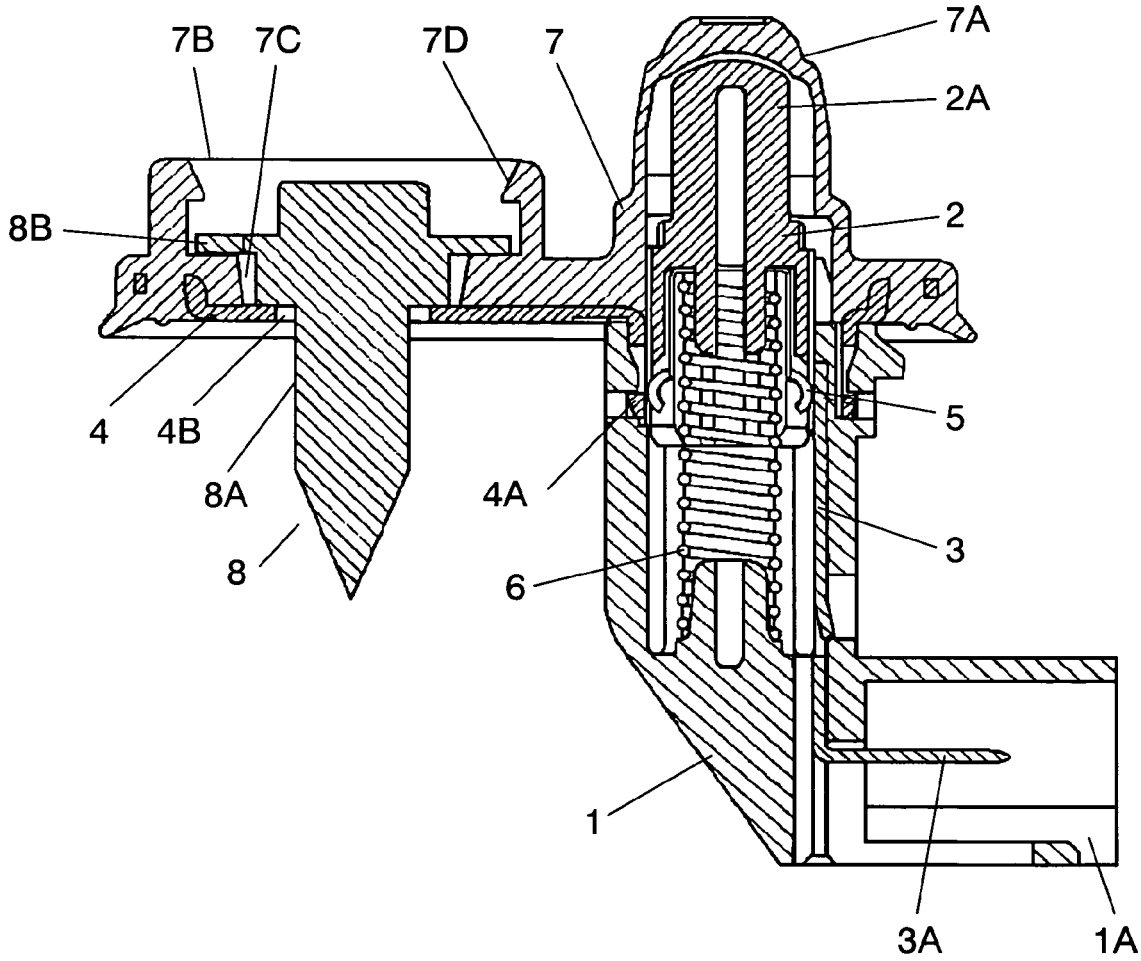
FIG. 4 is a sectional view of a conventional switch for vehicles.

As shown in the perspective view in FIG. 3B, protruded portion 14C in about annular shape protruding upward is provided on the outside of through hole 14B in mounting plate 14, while a plurality of flow holes 14D are formed on the outer face of protruded portion 14C.

Nearly U-shaped moving contact 5 made of a resilient metal plate such as of a copper alloy is mounted at nearly a central portion thereof on operation body 2, and the right and left ends of moving contact 5 are separately and resiliently contacted in a slightly deflected state to contact portion 14A and to fixed contact 3 of mounting plate 14.

Coil spring 6 made of a steel wire or a copper alloy wire is mounted in a slightly deflected state between the inner bottom surface of casing 1 and the lower surface of operation body 2. Operation body 2 is urged upward due to spring 6.

Cover 17 made of an elastic resin such as rubber or elastomer has mounting plate 14 insert-molded therein, covers the upper surface of mounting plate 14 as shown in a partial sectional perspective view of FIG. 3A, and has dome portion 17A thinly formed on the right side to cover the upper surface of casing 1 and operation body 2. Cylindrical portion 17B is formed on the upper side of through hole 14B of mounting plate 14.

Insertion hole 17C is formed in the bottom surface of cylindrical portion 17B, insertion hole 17C extending inward beyond through hole 14B of mounting plate 14 and having a diameter slightly smaller than the diameter of threaded portion 8A of metallic screw 8. Moreover, on the outer circumference of through hole 14B, the top face of protruded portion 14C formed in protrusion in about annular shape is exposed on the top face on the outside of insertion hole 17C.

At the time of insert-molding cover 17 and mounting plate 14, insertion hole 17C extending into through hole 14B is formed as the elastic resin for forming cover 17 flows inward of through hole 14B passing through the plurality of flow holes 14D formed in the outer side surface of protruding portion 14C along the outer periphery of through hole 14B.

Namely, the external portion of protruded portion 14C of cover 17 and insertion hole 17C are formed integrally through elastic resin filled in flow holes 14D.

Threaded portion 8A is forcibly inserted in insertion hole 17C which forcibly holds metallic screw 8 in cylindrical portion 17B so as not to escape upward. The lower surface of neck portion 8C of screw 8 comes in contact with the upper surface of protruded portion 4C exposed in the periphery of insertion hole 17C to thereby constitute the switch for vehicles.

The thus constituted switch for vehicles is preserved or transited in a state where screw 8 is forcibly held in cylindrical portion 17B of cover 17. Terminal portion 3A protruding at the lower side of casing 1 is connected by a lead wire (not shown) or the like to a lamp in the compartment through an electronic circuit (not shown) of an automobile. Screw 8 is fastened to the chassis (not shown) of the vehicle, and mounting plate 14 is grounded to the chassis via screw 8 and is attached to the door portion of the vehicle.

During the transit or at the time of attaching the switch to the vehicle, threaded portion 8A of screw 8 is forcibly held in insertion hole 17C in the inner bottom surface of cylindrical portion 17B; i.e., the whole outer periphery of threaded portion 8A is forcibly held in the whole inner periphery of insertion hole 17C over the thickness of insertion hole 17. This precludes such an inconvenience that screw 8 escapes despite a shock is given thereto to some extent or despite a certain degree of force is exerted from the lower side of screw 8. Namely, screw 8 is reliably held in cylindrical portion 7B of cover 17.

Further, screw portion 8A is forcibly held in insertion hole 17C and, hence, screw 8 is not loosened or displaced or does not float. At the time of mounting on the chassis, therefore, screw 8 can be easily positioned and fastened in the hole of the chassis.

Furthermore, because threaded portion 8A is press fit and held in insertion hole 17C for protection against displacement or inclination of screw 8, this facilitates to perform positioning and tightening of screw 8 in the chassis hole.

When an extreme force is exerted from the lower side of screw 8, screw 8 moves upward depending upon the force, and the lower surface of neck portion 8C of screw 8 separates away from the upper surface of protruded portion 14C that is exposed in the periphery of insertion hole 17C. This, however, precludes such an inconvenience that screw 8 completely escapes out of insertion hole 17C. This precludes such a cumbersome operation that screw 8 that has escaped must be inserted in cylindrical portion 17B again to fasten it. This facilitates the assembling and reduces the work.

In fastening screw 8 that is forcibly held, further, the outer portion of protruded portion 14C of cover 17 and insertion hole 17C are integrally formed via flow holes 14D of mounting plate 14. Therefore, even if insertion hole 17C is twisted accompanying the fastening of screw 8, the twisted portion does not affect the outer side of protruded portion 14C due to flow holes 14D, making it possible to preclude such an inconvenience that the outer side of protruded portion 14C of cover 17 is deformed. Screw 8 can be easily and reliably fastened in the cylindrical portion 17B.

In a state where screw 8 is fastened to the chassis of the vehicle, screw 8 moves downward due to the force of fastening, and the lower surface of neck portion 8C comes in contact with the upper surface of protruded portion 14C with a strong force due to resilient forces of the inner bottom surface of cylindrical portion 17B and of insertion hole 17C. This assures grounding of mounting plate 14 to the chassis.

In a state where the doors of the automobile are closed, operation portion 2A covered by dome portion 17A of cover 17 is pushed by the door, operation body 2 moves downward while deflecting spring 6, the left end of moving contact 5 mounted on operation body 2 separates away from contact portion 14A of mounting plate 14, the connection between contact portion 14A and fixed contact 3 is broken, and the lamp in the compartment is maintained turned off.

The door when it is opened separates away from operation portion 2A. Being urged by spring 6, therefore, operation body 2 moves upward. Contact point 5, too, moves up, returns back to the initial state of when turned on shown in FIG. 1, whereby the lamp is turned on in the compartment to illuminate the interior of the compartment.

According to the embodiment of the invention as described above, insertion hole 17C extending into through hole 14B in mounting plate 14 is formed in cylindrical portion 17B of cover 17 covering the upper surface of mounting plate 14 and operation body 2. Further, screw 8 is forcibly held in insertion hole 17C so that, even when a shock is given or a force is applied thereto from the lower side during the transit or at the time of attachment to the vehicle, a defect that screw 8 falls is avoided. Besides, screw 8 is temporarily held maintaining reliability and, thus, there is provided a switch for vehicles which can be easily assembled.

Further, protruded portion 14C protruding upward is provided on the outer side of through hole 14B of mounting plate 14, and a plurality of flow holes 14D are formed in the outer side surface of protruded portion 14C. The outer side of protruded portion 14C of cover 17 and insertion hole 17C are integrally formed through flow holes 14D. Even if insertion hole 17C is twisted accompanying the fastening of screw 8 at the time of attaching screw 8 to the chassis, the twisted portion does not affect the outer side of protruded portion 14C due to flow holes 14D, making it possible to preclude such an inconvenience that the outer side of protruded portion 14C of cover 17 is deformed, and screw 8 can be easily and reliably fastened in cylindrical portion 17B.

The skeleton of the invention will be described below briefly. That is, the switch for vehicles of the invention includes nearly box-like casing 1 having fixed contact 3 studded in the inner side surface thereof; and operation body 2 accommodated in casing 1 so as to move up and down. Further, the switch for vehicles includes mounting plate 14 which is anchored to casing 2, has contact portion 14A at one end thereof, extends outward of casing 1 and has through hole 14B formed in the other end thereof; and moving contact 5 mounted on operation body 2 and is resiliently contacted to fixed contact 3 and to contact portion 14A of mounting plate 14. Further, the switch for vehicles includes cover 17 covering the upper surface of mounting plate 14 and operation body 2, and having screw 8 inserted in insertion hole 17C in cylindrical portion 17B formed on the upper side of through hole 14B. Further, insertion hole 17C of cover 17 extends into through hole 14B of mounting plate 14, and screw 8 is forcibly held in insertion hole 17C.

In the above description, the whole outer periphery of threaded portion 8A is forcibly held in insertion hole 17C. However, the same effect can also be exhibited even by forming a plurality of slits to a predetermined depth in the up-and-down direction of insertion hole 17C, and partly and forcibly holding threaded portion 8A though the force for forcibly holding screw 8 may be slightly weakened.

INDUSTRIAL APPLICABILITY

The switch for vehicles of the invention temporarily holds the screw maintaining reliability and can be easily assembled. Particularly, the switch for vehicles is useful for detecting the opening and closure of doors of the automobile, and offers a high degree of industrial applicability.

The invention claimed is:

1. A switch for vehicles comprising:

a nearly box-like casing having a fixed contact studded in an inner side surface thereof;

an operation body accommodated in the casing so as to move up and down;

a mounting plate which is anchored to the casing, has a contact portion at one end thereof, extends outward of the casing, and has a through hole formed in another end thereof;

a moving contact mounted on the operation body and resiliently contacted to the fixed contact and to the contact portion of the mounting plate; and a cover made of an elastic resin and insert-molded to the mounting plate, covering an upper surface of both the mounting plate and the operation body, and having a screw inserted in an insertion hole in a cylindrical portion formed on an upper side of the through hole;

wherein the insertion hole of the cover extends into the through hole of the mounting plate, and the screw is forcibly held in the insertion hole.

2. The switch for vehicles of claim 1, wherein a protruded portion protruding upward is provided on an outer side of the through hole of the mounting plate, a plurality of flow holes are formed in an outer side surface of the protruded portion, and the outer side of the protruded portion of the cover and the insertion hole are integrally formed through the flow holes.

3. The switch for vehicles of claim 1, wherein the moving contact is made of a resilient metal, an end of the moving contact is resiliently contacted to the contact portion, the other end of the moving contact is resiliently contacted to the fixed contact, and the central portion of the moving contact is mounted on the operation body.

4. The switch for vehicles of claim 1, wherein the insertion hole is formed in an inner bottom surface of the cylindrical portion, the insertion hole extending inward beyond the through hole in the mounting plate, and having a diameter smaller than that of the threaded portion.

* * * * *